United States Patent [19]

Lecat

[11] 4,034,154

[45] July 5, 1977

[54] DEVICE FOR REDUCING THE RADIO AND AUDIBLE NOISE CAUSED BY CORONA ON HIGH VOLTAGE ELECTRICAL INSTALLATIONS

[75] Inventor: Albert Pierre Marie Lecat, Rixensart, Belgium

[73] Assignee: Laboratoire Belge de l'Industrie Electrique (LABORELEC), Linkebeek, Belgium

[22] Filed: Dec. 11, 1975

[21] Appl. No.: 639,686

Related U.S. Application Data

[63] Continuation-in-part of Ser. No. 497,449, Aug. 14, 1974, abandoned, which is a continuation-in-part of Ser. No. 279,157, Aug. 9, 1972, abandoned.

[30] Foreign Application Priority Data

Aug. 17, 1971 Belgium ..... 107129

[52] U.S. Cl. ..... 174/127; 174/4 R; 361/117

[51] Int. Cl.² ..... H01B 5/00

[58] Field of Search ..... 174/127, 4 R, 3; 317/61

[56] References Cited

UNITED STATES PATENTS

| | | | |
|---|---|---|---|
| 1,515,293 | 11/1924 | Whitehead | 174/127 |
| 3,102,161 | 8/1963 | Raisbier | 174/127 |

FOREIGN PATENTS OR APPLICATIONS

| | | | |
|---|---|---|---|
| 774,412 | 9/1971 | Belgium | 174/127 |
| 639,040 | 6/1950 | United Kingdom | 174/127 |

OTHER PUBLICATIONS

Cigre Report 9/1/72, pp. 11–15.

*Primary Examiner*—E. A. Goldberg
*Attorney, Agent, or Firm*—Sughrue, Rothwell, Mion, Zinn and Macpeak

[57] ABSTRACT

A device is described for substantially reducing the radio interference and audible noise caused by the corona appearing on the surface of electrically conductive members supplied with a high electric voltage. The device comprises an electrically conductive mounting portion to be mounted on the surface of the live member in electrical contact therewith and at least one electrically conductive projecting portion projecting therefrom in directions substantially normal to said surface of the live member. The end of the projecting portion remote from the mounting portion has a radius of curvature which is small relative to its length, the dimension of the projecting portion being optimized such that, during use of the live member, said end of the projecting portion is located in a well-defined zone of electrical field around the live member where a unique relatively non-disturbing ionization mode is produced. This device is applicable to localized live components or parts such as in high voltage power stations or overhead lines.

4 Claims, 6 Drawing Figures

DEVICE FOR REDUCING THE RADIO AND AUDIBLE NOISE CAUSED BY CORONA ON HIGH VOLTAGE ELECTRICAL INSTALLATIONS

This application is a continuation-in-part of application Ser. No. 497,449 filed Aug. 14, 1974 and abandoned upon the filing of this application. Application Ser. No. 497,449 was in turn a continuation-in-part of application Ser. No. 279,157 filed Aug. 9, 1972 and abandoned upon the filing of application Ser. No. 497,449.

The present invention relates to a device for reducing the radio interference and audible noise caused by corona on electrically conductive members supplied with a high electric voltage.

Corona produces radio interference and audible noise which can be disturbing when the corona reaches high levels, for instance under unfavourable meteorological or atmospheric conditions, or pollution or oxidation of the surfaces of the live members. This problem of noise pollution due to corona has been and still is well recognised in the field of art as evidenced by the International Conferences on high voltage electric networks (CIGRE).

Up to now various means have been used to reduce corona. A first means consists in making the radium of curvature of the live member larger, resulting generally in increased size and weight. A second means consists in making the surfaces of the member as smooth as possible. All these known means are generally onerous and often relatively ineffective, namely under moist atmospheric conditions, e.g. where water droplets are present on their surface.

The need for improved means of reducing the noise pollution has been stressed at the CIGRE last meetings.

The invention has for its object a simple and inexpensive device for reducing effectively the radio interference and audible noise caused by corona.

The basic aspect of the invention is providing means arranged on the surface of high voltage members such that the magnitude of the electric field around said members is locally increased whereby the usual disturbing ionization mode of the surrounding air is replaced by a specific, different, less disturbing ionization mode which inhibits the corona phenomenon and its disturbing consequences.

The device of the invention comprises a plurality of elongated electrically conductive members adapted to be mounted in electrical contact with an in a projecting relationship onto the surfaces to be protected. The geometric characteristics of the device such as the length of the projecting members, the radius of curvature at their ends, the density of their distribution onto the surface must be determined according to the particular and environmental conditions. The optimisation of these factors depend on the shape of the member to be protected, its surface condition and the average surface electric field.

The invention will appear more clearly on reading the following description made relative to the attached drawings, wherein.

Figure 1:
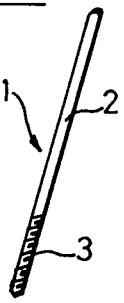
FIG. 1 illustrates a first embodiment of the device according to the invention.

Referring to FIG. 1 there is shown a first embodiment of the device of the invention comprising a single elongated electrically conductive member 1 having a projecting portion 2 and a mounting portion 3 arranged for being fixed onto and in electrical contact with the surface of a high voltage member. The projecting portion 2 has an end with a radius of curvature which is small relative to its length.

The geometric characteristics must be chosen in each particular case such as to optimise the operation. It has been found, however, that these characteristics are bound within defined limits. The diameter of the projecting portion adjacent the end thereof should be from 1 to 2 mm approximately such that the radius of curvature at the end of the projecting portion is from 0.5 to 1 mm. The length of the projecting portion should be from 5 to 30 mm approximately. The number of such elongated member 1 on the surface of the high voltage member to be protected should be such that the distribution density is approximately from one device for a 25 $cm^2$ area to one device for a 400 $cm^2$ area, depending on the surface condition and curvature. The above values are given for a device to be adapted onto a member the shape of which was designed yet with a view to reduce corona. It is to be understood however that the method of the invention may be applied from the moment when the high voltage member is designed. In such a case said member would have a minimum sized shape with possible sharp edges at suitable locations and the optimal geometric characteristics may be different from that indicated above for the correction device. In particular, the length of the projecting portions may be greater than and the distribution density different from the illustrative values above such that their ends are located in the appropriate zones of electric field.

The ends of the projecting members should be located in an always existing, well defined zone of electric field around the high voltage member so that the usual ionization mode of the surrounding air is replaced by a new one producing no radio interference or audible noise. The phenomenon can be observed in the dark. When high voltage is applied to the electrical member, stable little bright spherical glows having a diameter tha not exceeds 1 cm approximately, appear at the ends of the projecting members instead of the conventional high-intensity corona discharge at the surface of the live electrical member. In effect, the device of the invention uses a particular point-effect which has the unpredictable and unobvious result to produce said new ionization mode.

Further, it has been found that said reduction of the radio interference and audible noise is notable as well under moist atmospheric conditions of any type, e.g. rain, drizzle, fog, spray, etc. as under dry conditions and when the device of the invention is applied onto clean, smooth, contaminated, oxidised or rugged surfaces as well.

Figure 3:
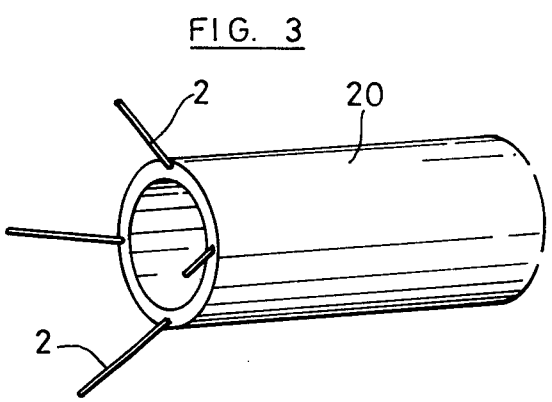
FIGS. 2 and 3 illustrate two typical applications of the device of FIG. 1.
Figure 2:
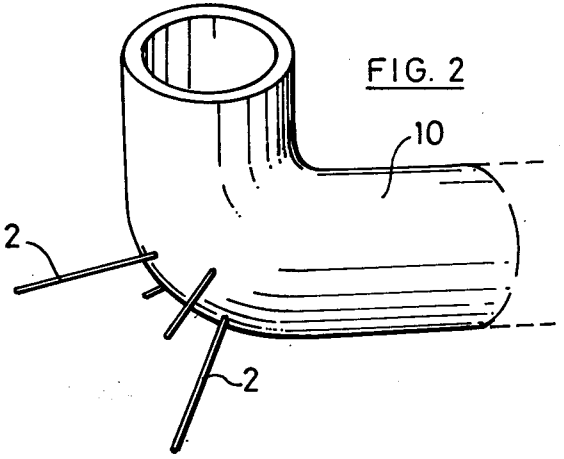

FIGS. 2 and 3 illustrate two ways of arranging a number of elongated members such as member 1 of FIG. 1 on a bent and a straight tubular bar, 10 and 20 respectively, as currently used for bus bars in high voltage stations. On FIG. 3 the device of the invention, comprising four elongated members 1, replaces the spherical member usually located at the end or the bar.

Figure 6:
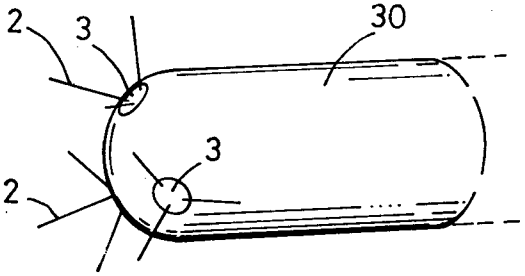
FIGS. 5 and 6 illustrate two typical applications of the device of FIG. 4.
Figure 5:
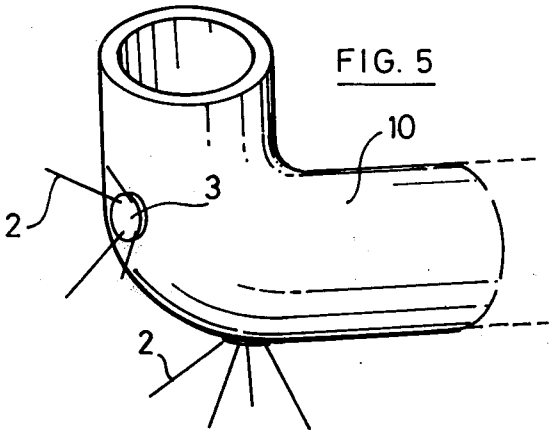
Figure 4:
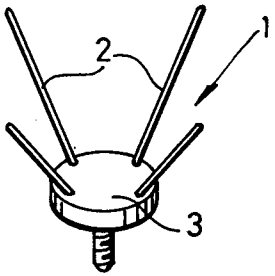
FIG. 4 illustrates a second embodiment of the device according to the invention.

FIG. 4 shows a second embodiment of the device comprising a plurality (illustratively four) of projecting members 2 mounted on a single mounting member 3. FIG. 5 and 6 illustrate two ways of arranging a number of such device on a bent and a rounded-end bar, 10 and 30 respectively.

The method for fixing the elongated members 2 is unimportant provided that a sufficient electrical contact with the high voltage member on which it is desired to reduce the disturbances caused by corona is ensured.

As apparent from the foregoing, the essential characteristic features which distinguish the invention from the prior art may be briefly summarized as follows:

a. the invention is concerned with the reduction of radio and audible noise pollution due to corona in high voltage installations, and consequently, the noise pollution of the environment;

b. the invention provides means having relatively sharp projecting portions arranged on the surface of high voltage members thereby to increase locally the electric field around said members with the unpredictable and unobvious result of producing, when high voltage is applied, a different ionization mode of the surrounding air which inhibits the corona phenomenon and consequently is less disturbing in term of noise pollution;

c. the specific ionization mode produced by using the invention can easily be observed in the dark: stable little bright spherical glows appear at the end of the projecting portions; these glows are quite different from the visual effect of the conventional high-intensity corona discharge at the surface of the live high voltage members;

d. an advantage of the invention is that the result is achieved in any surface or environmental condition whatever;

e. the invention is applicable to localised live members contrary to any known means which are not.

In view of these features, the invention is manifestly a substantial step forward in the art concerned with noise pollution around high voltage installations.

What is claimed is:

1. In combination, a high voltage member and a device for reducing the radio and audible noise caused by corona, said device comprising an electrically conductive member in the form of a conductive flat nonperforate disc with a mounting means extending from one flat side thereof, said mounting means and said disc being in substantial electrical contact with the high voltage member, and a plurality of electrical projecting portions projecting from a second flat side of said disc in fan order with their ends remote from the mounting means and being substantially evenly spaced from each other and having radii of curvature that are small relative to their lengths, said projecting portions having lengths such that, during the use of the combination, the ends of the projecting portions remote from the mounting means are located in a well-defined zone of electrical field around said high voltage member where the local electric field has a magnitude such that the usual distrubing ionization mode of the surrounding air is replaced by a new ionization mode producing substantially no radio or audible noise and characterized by stable, small bright spherical glows which are observable in the dark at the ends of said projecting portions.

2. The combination recited in claim 1 wherein the lengths of the projecting portions are between 5 and 20 mm.

3. The combination recited in claim 1 wherein a plurality of said devices are evenly distributed over the surface of said high voltage member with a distribution density of approximately from one device for a 25 $cm^2$ area to one device for a 400 $cm^2$ area.

4. The combination recited in claim 2 wherein the diameters of the projecting portions adjacent the ends thereof remote from the mounting means are between 1 and 2 mm so that the radii of curvature at the ends of said projecting portions are from 0.5 to 1 mm.

* * * * *